US007830330B2

(12) United States Patent
Pelzer

(10) Patent No.: US 7,830,330 B2
(45) Date of Patent: Nov. 9, 2010

(54) ANTENNA CONFIGURATION

(75) Inventor: Heiko Pelzer, Erkelenz (DE)

(73) Assignee: NXP B.V., Eindhoven (NL)

( * ) Notice: Subject to any disclaimer, the term of this patent is extended or adjusted under 35 U.S.C. 154(b) by 142 days.

(21) Appl. No.: 10/594,021

(22) PCT Filed: Mar. 3, 2005

(86) PCT No.: PCT/IB2005/050788

§ 371 (c)(1),
(2), (4) Date: Apr. 24, 2007

(87) PCT Pub. No.: WO2005/093899

PCT Pub. Date: Oct. 6, 2005

(65) Prior Publication Data

US 2007/0229387 A1 Oct. 4, 2007

(30) Foreign Application Priority Data

Mar. 25, 2004 (EP) ..... 04101236

(51) Int. Cl.
*H01Q 3/24* (2006.01)

(52) U.S. Cl. ..... 343/876; 343/700 MS; 343/702; 343/850; 343/860

(58) Field of Classification Search ..... 343/700 MS, 343/745

See application file for complete search history.

(56) References Cited

U.S. PATENT DOCUMENTS

| | | | | |
|---|---|---|---|---|
| 5,774,025 | A * | 6/1998 | Adam et al. | 333/24.1 |
| 6,819,290 | B2 * | 11/2004 | Hani et al. | 343/700 MS |
| 2009/0066584 | A1 * | 3/2009 | Thornell-Pers | 343/702 |

FOREIGN PATENT DOCUMENTS

| | | | |
|---|---|---|---|
| EP | 1 109 251 | | 6/2001 |
| EP | 1 289 053 | | 3/2003 |
| EP | 1469549 | A1 * | 10/2004 |
| EP | 1471597 | A1 * | 10/2004 |
| JP | 11 136025 | | 5/1999 |
| WO | WO 0120718 | A1 * | 3/2001 |

* cited by examiner

*Primary Examiner*—Trinh Vo Dinh

(57) ABSTRACT

Regarding an antenna configuration (1) preferably provided for a telecommunication device and comprising a first resonator structure (6) and second resonator structure (RS) being capacitive coupled with the first resonator structure (6) it is suggested to provide the antenna configuration (1) with a control electrode (2) and a switching stage (3), said control electrode (2) by means of the switching stage (3) being switchably connected to ground (G) and said switching stage (3) enabling to change capacitive coupling of the two resonator structures (6, RS) and thus to change the resonance frequency of the antenna configuration (1) and making possible to switch between a first frequency range and a second frequency range for enhancing the bandwidth and achieving improved matching of the antenna configuration (1).

8 Claims, 3 Drawing Sheets

ANTENNA CONFIGURATION

RELATED APPLICATIONS

This application is a 371 of PCT/IB05/50788 filed Mar. 3, 2005, which claims priority under 35 U.S.C. 119 to an application EPO 04101236.0 filed in the Europe on Mar. 25, 2004, the contents of which are incorporated herein by reference.

FIELD OF THE INVENTION

The invention relates to an antenna configuration for telecommunication devices, a telecommunication device comprising this antenna configuration, and a method of operating a telecommunication device. Such an antenna configuration being provided for usage in wireless hand-held communication devices such as mobile phones or data communication cards such as memory cards for use in laptops and the like.

BACKGROUND OF THE INVENTION

In the area of wireless telecommunication electromagnetic waves in the microwave region are used to transfer information. An essential part of the telecommunication device is thus the antenna configuration, which enables the reception and the transmission of electromagnetic waves.

Future telecommunication devices are expected to satisfy a couple of improvements at the same time. On the one hand they are expected to be smaller than today which also means that their antenna configuration has to shrink in size. On the other hand their radiation efficiency is expected to be higher, and their frequency bandwidth to be larger than today.

Higher radiation efficiency ensures a longer life of the batteries of a hand-held telecommunication device. A higher frequency bandwidth enables a multiband operation, for example an operation both in the GSM (Global System for Mobile Communication) frequency band, the DCS (Digital Communication System) frequency band, and the UMTS (Universal Mobile Telecommunication System) frequency band. As the frequency bandwidth and the efficiency of an antenna configuration depend on the antenna configuration concept and on the absolute size of the antenna configuration, a compromise has to be found between the size on the one hand, and the above-mentioned properties on the other hand. As an example, a smaller antenna configuration leads to a smaller bandwidth in most antenna configuration designs.

Patent document EP 1 289 053 A2 discloses an SMD-antenna configuration comprising a ceramic substrate on which ceramic substrate metallic strip conductors are printed. This printed wire antenna configuration being designed as a dual-band antenna: The strip conductors having a width and a length for enabling the stimulation both of a fundamental mode and a second harmonic.

OBJECT AND SUMMARY OF THE INVENTION

It is an object of the invention to provide a very small antenna configuration being suitable for application in telecommunication devices and in contactless operating data carriers, like smart cards, and a corresponding telecommunication device with an increased bandwidth, and to provide a method for operating a telecommunication device ensuring a higher bandwidth.

The object mentioned above being solved by the features of the independent claims. Preferred solutions according to the invention are characterized in the features of the dependent claims. It should be emphasised that any reference signs in the claims shall not be construed as limiting the scope of the invention.

According to the present invention the above-mentioned problem is solved by an antenna configuration for telecommunication devices, particularly hand-held telecommunication devices, wherein the antenna configuration comprising a first resonator structure and a second resonator structure and a control electrode said two resonator structures are capacitive coupled to one another and said control electrode) being provided and realized for changing the capacitive coupling between the first resonator structure an the second resonator structure and wherein the control electrode being contactable from outside the antenna configuration and wherein a switching means being associated with the control electrode, by means of the switching means the control electrode being connectable to a reference potential.

Furthermore the above-mentioned problem is solved by a method of operating a telecommunication device comprising an antenna configuration, wherein the antenna configuration comprises a control electrode said control electrode is contacted from outside the antenna configuration, and for changing the resonance frequency of the antenna configuration contacting of the control electrode from outside is done by switchably connecting the control electrode to ground.

The invention rests on the idea that each antenna configuration has a resonance frequency $f_R$, the value of said resonance frequency $f_R$ depends on the impedance of the antenna configuration. In case of the antenna configuration comprising a control electrode, which control electrode being provided and realized for changing the capacitive coupling between the first resonator structure and the second resonator structure and in a preferred solution being electrically isolated from other (metallic) parts of the antenna configuration, and in case of the control electrode is connected to a reference potential and in a preferred solution to ground, that means to ground potential, the impedance of the antenna configuration and thus the resonance frequency of the antenna configuration are changed. By a switching means associated with the control electrode a switchable connection of the control electrode to reference potential (ground) being realized, such that the resonance frequency can be switched as well. By this approach the resonance frequency of the antenna configuration can simply be switched between a first frequency band and a second frequency band, for example between the GSM band and the UMTS band.

By means of the measures according to the invention an increase of the bandwidth of the antenna configuration without the necessity of increasing the size of the antenna configuration. In case of the bandwidth is sufficiently high, a switchable connection between reference potential (ground) and the control electrode can be used to decrease the size of the antenna configuration.

As can be derived from the above explanation the switchable connection can also be used to switch the resonance frequency within a given frequency band from a first sub-band to a second sub-band. As an example switching within the GSM band between the Rx-band to the corresponding Tx-band is possible. Another example being switching within the UMTS band from the upper sub-band ranging from 2100 MHz to 2200 MHz to the lower sub-band ranging from 1880 MHz to 2025 MHz and vice versa. In this case a duplexer to split the frequency band in the corresponding sub-bands is no longer needed, or its design can be simplified. In the latter case the duplexer and the telecommunication device can be made smaller and less expensive.

Another advantage associated with the above mentioned switchable connection is the possibility for an improved matching of the antenna configuration in the frequency range wherein the antenna configuration is operated, which in turn leads to a higher total efficiency and less power consumption. Matching the antenna configuration means that the value of the impedance of the antenna configuration is adapted to be equal to the value of the impedance of the feed line, the latter value being 50 ? in most cases. By satisfying this requirement the best total efficiency being achieved. In case of an ill-matched antenna configuration the input signal is partially reflected which decreases the efficiency of the device comprising this antenna configuration. The above-mentioned switchable connection makes it possible to compensate for deviations from this requirement, and thus to optimize the matching conditions.

An additional advantage of the above-mentioned switchable connection is that elements for damping the reflected input signal are no longer needed or can be simplified in design and size, which in turn reduces production costs. These damping elements are particularly necessary in UMTS devices as a reflected input signal leads to a decreased efficiency and malfunctions of UMTS power amplifiers.

As a matter of fact, more than one control electrode can be chosen which can be connected to reference potential (ground) by one or more switching units. It is not a mist that the one control electrode being electrically totally isolated from all other parts of an antenna configuration. A control electrode my be connected by an additional conductive connection lead with the first resonator structure provided that the functionally of the control electrode, namely to change the capacitive coupling between the first und second resonator structures being not negatively influenced.

In general a larger control electrode is responsible for a larger shift of the resonance frequency or the impedance. The size of the shift depends on the size and the position of the control electrode. In experiments with UMTS antennas of the DBA type a resonance shift to lower frequencies could be reliably realized.

Experiments have shown that the control electrode itself does not change the efficiency of the antenna configuration. However, by using the control electrode in order to improve the matching conditions of the antenna configuration, the efficiency of the antenna configuration can be improved as explained above.

The switching means may form part of the antenna configuration, or may be an external unit with respect to the antenna configuration. As a matter of fact it is possible that only parts of a switching means reside on or in the antenna configuration, and other parts are exterior to the antenna configuration.

As explained above, the switching means is designed to connect the control electrode to a reference optional, preferred to ground. In the majority of cases ground is the mass metallization of a printed circuit board. The reference potential has not to be in all cases ground potential because other reference potentials can also be applied.

The switchable connection between a reference potential (ground) and a control electrode can be used to increase the bandwidth of all antennas having a resonance frequency depending on its impedance. In this respect a planar inverted F antenna, a shorted patch antenna, or a stub antenna can be used.

In order to achieve a particularly small antenna configuration it has proved advantageous if the antenna configuration comprising a dielectric substrate retaining the first metallic resonator structure and the second resonator metallic structure. The first metallic resonator structure is connected to a feed line on the dielectric substrate (5) and being thus called feed structure. The second metallic structure by means of the dielectric substrate being electrically isolated from the first resonator structure and being located adjacent to the first resonator structure (feed structure) and being connected to ground. Resonance can be stimulated by means of the second metallic resonator structure. Therefore the second metallic resonator structure being called resonant ground structure. An antenna configuration as mentioned above being called dielectric block antenna (DBA). Further details regarding this type of antenna, particularly the geometric shape and the material of the metallic structure, the methods to manufacture the elongated metallic structures, and the materials capable for realizing a substrate are disclosed in patent document EP 1 289 053 A2. This specification explicitly refers to that patent document.

A dielectric block antenna can be designed in such a way that the feed structure and the resonant ground structure are realized by printed structures printed on the surface of the substrate.

In alternative the feed structure and the resonant ground structure are at least partially located in the interior of the substrate. This solution has the advantage that there are additional layers in order to implement more than two structures placed one on top of the other. This fact allows an antenna configuration design having more than one resonance frequency, for example two or three, which enables a multi-band operation. Placing the structures one on top of the other can be done by manufacturing the antenna by means of low temperature cofired ceramics technology (LTCC-technology).

Various types of known switching means known in the prior art can be used to establish the switchable connection between the control electrode and a reference potential, as ground potential. A switching means may comprise a capacitor or a PIN diode. As it is desirable to use a switching means consuming not much power, the switching means may comprise a low loss semiconductor switch such as a MEM-switch or standard FET switches based on CMOS or GaAs technology.

Providing a switchable connection with one of the switching means mentioned above makes it possible to change the resonance frequency in a discrete step, such that the value of $f_R$ is changed by a fixed amount of $\pm ?f_R$.

When a switching means comprises a variable capacitance diode, the variable capacitance diode can be used to enable a continuous change of the resonance frequency.

Another aspect of the invention relates to a telecommunication device, particularly a mobile phone, comprising an antenna configuration as described above. In most cases an antenna configuration being connected to a printed circuit board. In order to achieve a particularly small device the largest surface of the antenna configuration is vertically aligned with respect to the largest surface of the printed circuit board (PCB). With this solution a minimum area only being covered by the antenna configuration such that only a minimum area is not usable for other components on the PCB. An antenna configuration can be positioned at the top and/or the side of the PCB. A preferred embodiment of an antenna configuration is realized as a so-called antenna module.

These and other aspects of the invention will be apparent from and elucidated with reference to the embodiments described herein thereafter.

DESCRIPTION OF EMBODIMENTS

Figure 1:
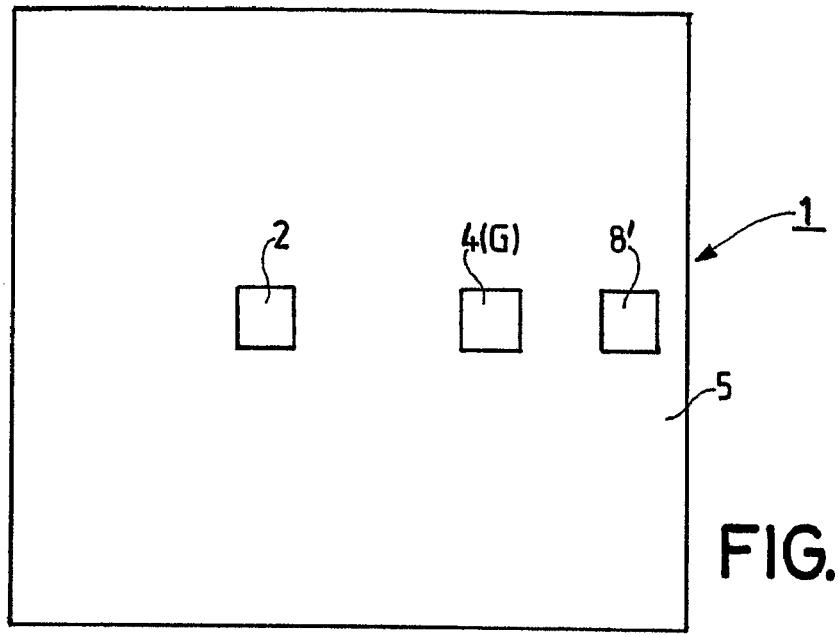
FIG. 1 shows by means of a top view an antenna configuration according to an embodiment of the invention.

FIG. 1 shows an embodiment of an antenna configuration 1 having a size of 12×11×1 $mm^3$ and being manufactured by LTCC-technology. The antenna configuration 1 comprises a dielectric substrate 5 said substrate being basically made of a ceramic and contains an antenna structure AS in its interior (not shown in FIG. 1). In more detail the dielectric substrate 5 consists of ten (10) sintered layers of ceramic foils said ceramic foils, in the sintered state, have a dielectric constant of 9.6. The metallization of the track conductors representing the resonant structures (not shown in FIG. 1) consists of a burned silver paste. Only three pads of the antenna configuration 1 are shown in FIG. 1, namely a control electrode 2 and a ground electrode 4 and a feed electrode 8', said ground electrode 4 being connected to ground G.

Figure 2:
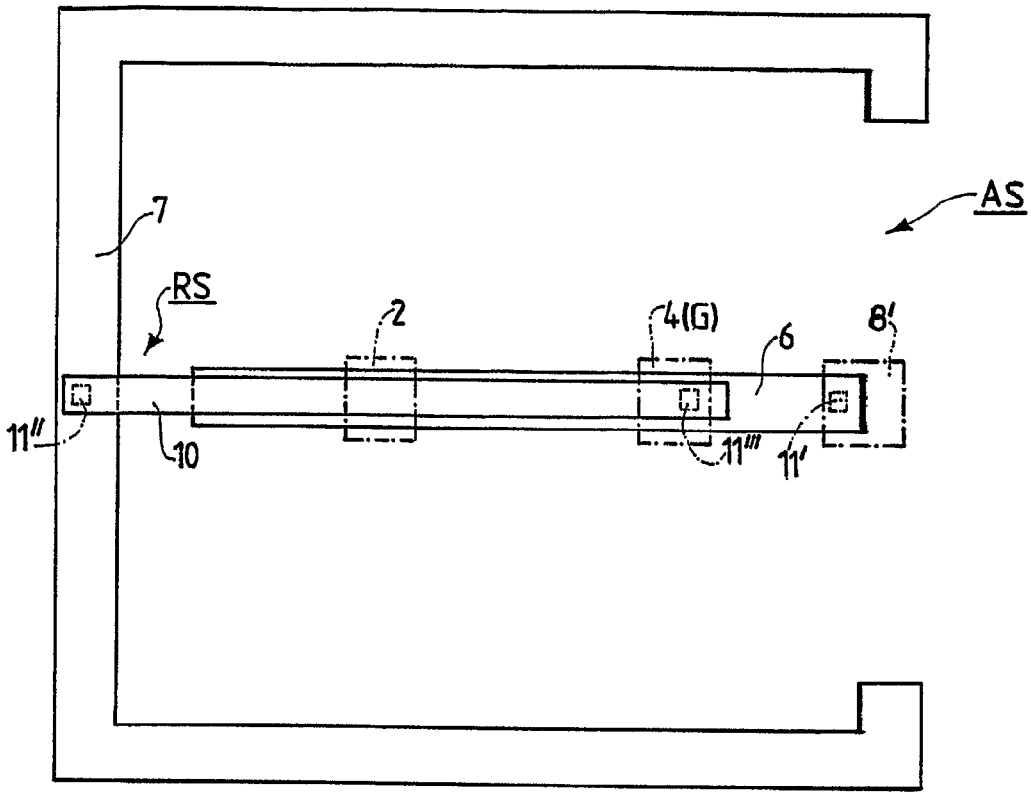
FIG. 2 shows by means of a top view an antenna structure being incorporated in the antenna configuration according to FIG. 1.

FIG. 2 shows the antenna structure AS, which is located interior of the antenna configuration 1 according to FIG. 1. The antenna configuration 1 is a dielectric block antenna and comprises a stripe-shaped first resonator structure 6 and an U-shaped resonator structure 7. Both structures 6 and 7 being metallic structures as already mentioned above. For comparison purposes only the three electrodes 2, 4 and 8' shown in FIG. 1 are shown in FIG. 2 by dash-dotted lines. Instead of a stripe-shaped first resonator structure 6 a first resonator structure with another shape may be provided, e.g. a sinus-shaped or a meander-shaped first resonator structure. Instead of an U-shaped resonator structure 7 a V-shaped resonator structure or a W-shaped resonator structure may be provided.

Figure 3:
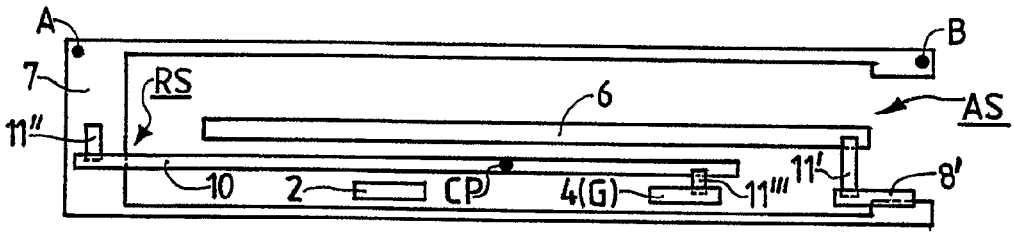
FIG. 3 shows by means of a tilted side view the antenna structure according to FIG. 2.

As FIG. 3 shows a tilted side view of the antenna configuration 1 hidden elements according to FIG. 2 are shown in FIG. 3. The tilted side view according to FIG. 3 is obtained by rotating the antenna configuration 1 according to FIG. 2 about the direction of length of the first resonator structure anticlockwise.

The antenna configuration 1 comprises the stripe-shaped first resonator structure 6 which is connected to the feed electrode 8' by means of a first via 11' at its right edge according to FIG. 3. Feed electrode 8' is connected to a frequency generator by a 50 ? feed line (not shown). Furthermore the antenna structure AS comprises a second resonator structure RS consisting of the U-shaped resonator structure 7 and a stripe-shaped auxiliary resonator structure 10 contacted to one another by means of a second via 11". The stripe-shaped auxiliary resonator structure 10 is connected to the ground electrode 4 by means of a third via 11'''. The ground electrode 4 is connected to the mass metallization of a device (not shown) incorporating the antenna configuration 1. The second resonator structure RS being realized as a combined resonator structure realized by the combination of the U-shaped resonator structure 7 and the stripe-shaped auxiliary resonator structure 10. The first resonator structure 6 being called also feed structure. The second resonator structure RS being called also resonant ground structure. Instead of a stripe-shaped auxiliary resonator structure an auxiliary resonator structure with another shape may be provided, e.g. a sinus-shaped or meander-shaped auxiliary resonator structure.

When used to emit radiation the input signal is transferred to the first resonator structure 6. The first resonator structure 6 shows a capacitive coupling to the second resonator structure RS. The resonance is stimulated in the second resonator structure RS. The second via 11" contacts the U-shaped resonator structure 7, and serves as a branching point for the U-shaped and thus symmetric resonator structure 7.

The resonance frequency is determined by the dielectric constant of the dielectric substrate made of ceramic and by the length of resonator structure. This length is defined (see FIG. 3) by the length from coupling point CP to second via 11" and from there to points A and B.

The coupling point CP of the auxiliary resonator structure 10 is an imaginary point which can be calculated and which is defined as the point at which the electric field strength between the first resonator structure 6 and the auxiliary resonator structure 10 is highest. Furthermore, the electric current within the second resonator structure RS has a node at coupling point CP.

The width of the metallic track conductors, the symmetrically designed U-shaped resonator structure 7 and the distance of the first resonator structure 6 to the second resonator structure RS determine the matching of the antenna configuration 1.

Figure 4:
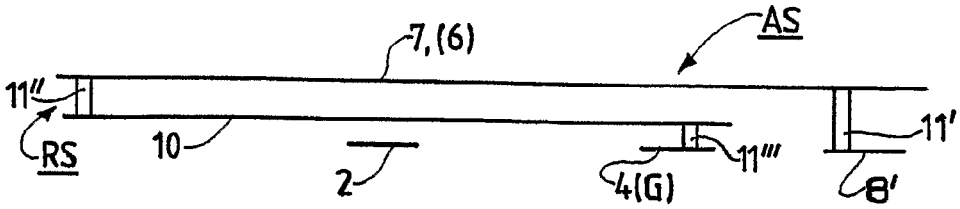
FIG. 4 shows by means of a side view the antenna structure according to FIGS. 2 and 3.

FIG. 4 is a side view of the antenna configuration 1 according to FIG. 1, and is obtained by rotating the antenna configuration 1 according to FIG. 3 even more about the direction of length of the first resonator structure 6 anticlockwise.

By means of the control electrode 2—in this case not being connected to the first resonator structure 6 or the second resonator structure RS and thus being electrically isolated from the first resonator structure 6 and the second resonator structure 7 and from all other parts of the antenna configuration 1—it is achievable to change the capacitive coupling between the first resonator structure 6 and the second resonator structure RS. Investigations regarding the energy flow in the antenna configuration 1 and the antenna structure AS, respectively, have shown that the switchable connection of the control electrode 2 to ground G shifts the coupling point CP between the first resonator structure 6 and the auxiliary resonator structure 10 changing the effective length of the resonant structure. More specifically, coupling point CP is moved in a direction to the first via 11', which means that the length of the resonator structure is increased.

Figure 5:
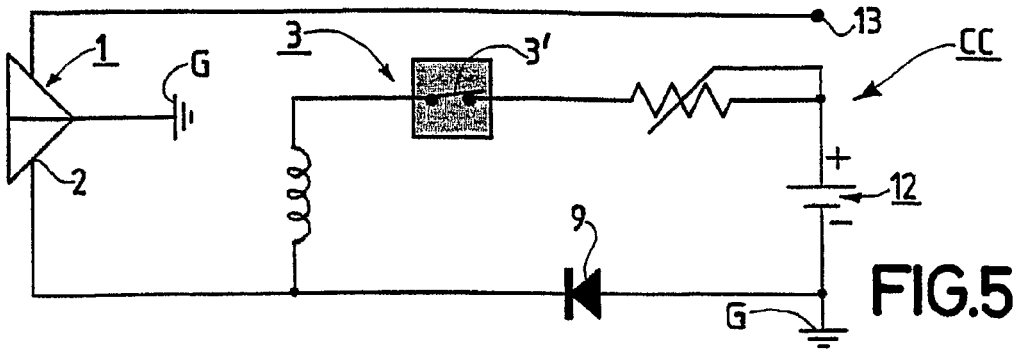
FIG. 5 shows a control circuit for a continuous change of the impedance of the antenna configuration according to FIG. 1.

The control electrode 2 can be connected to ground G by means of a switching means 3 comprising a switch 3' and a pin diode 9 as shown in FIG. 5. FIG. 5 shows a control circuit CC being capable for triggering the pin diode 9 said pin diode 9 being powered by a DC-source 12. The control circuit CC comprises the switching means 3 with its switch 3'. A radio frequency signal is transferred from a port 13 to the antenna configuration 1. When pin diode 9 is switched by means of the switch 3' into its non-conductive mode the antenna configuration 1 is working in the UMTS frequency range. When pin diode 9 is switched by means of the switch 3' into its conductive mode and therefore the switchable connection between control electrode 2 and ground G being short circuited, the resonance frequency is 170 MHz lower. In the latter case the antenna configuration 1 is operating in the DCS/PCS frequency range. It is to mention that instead of a pin diode it is possible to provide a semiconductor switch or to provide a variable capacitance diode as part of switching means 3.

Figure 6:
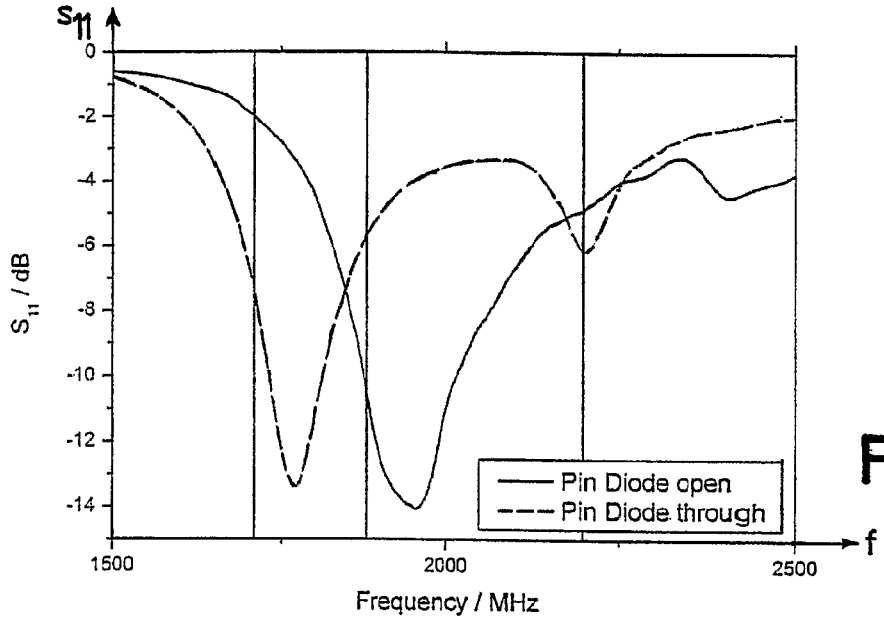
FIG. 6 shows a diagram with scattering parameter of the antenna configuration according to FIG. 1 dependant on the switchable connection established by a pin diode.

FIG. 6 shows a diagram showing the scattering parameter $s_{11}$ of the antenna configuration 1 as a function of frequency f. When pin diode 9 is switched by means of the switch 3' to open (case A), the control electrode 2 is not connected to ground G, such that the device operates in the UMTS band. When pin diode 9 short circuits the switchable connection between ground G and the control electrode 2 (case B), the resonance frequency is lowered by 170 MHz such that the antenna configuration 1 operates in the DCS band. This means that a telecommunication device with such an antenna configuration 1 can operate both in the DCS/PCS band ranging from 1710 MHz to 1990 MHz, and in the UMTS band ranging from 1880 MHz to 2200 MHz. In other words the bandwidth has been increased by the switchable connection between ground G and the control electrode 2.

Figure 7:
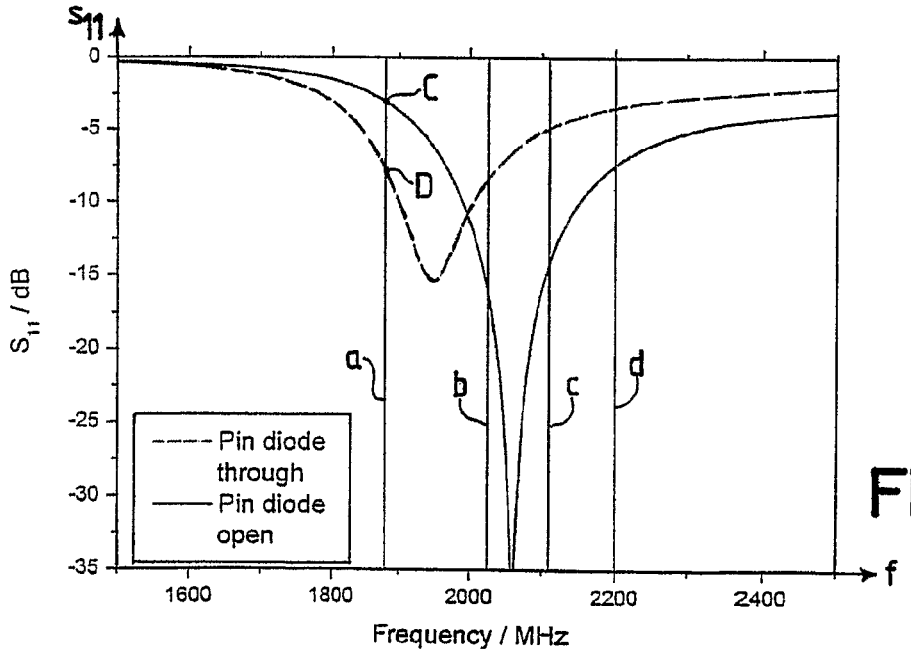
FIG. 7 shows a diagram with scattering parameter of the antenna configuration according to FIG. 1 for switching the resonance frequency within the UMTS band from the upper sub-band to the lower sub-band.

FIG. 7 shows a diagram showing the simulated scattering parameter $s_{11}$ of an amended antenna configuration as a function of frequency f. In comparison to the embodiment described above the amended antenna configuration shows a length of the second resonator structure RS being slightly shorter, and the position of the control electrode 2 has been laterally shifted. The amended antenna configuration is adapted to be switched from the lower UMTS sub-band (1880 MHz to 2025 MHz) to the higher UMTS sub-band (2110 MHz to 2200 MHz). The vertical lines a, b, c and d represent the edges of the sub-bands. The plot shows that a switchable connection between ground G and the control electrode 2 can be used to improve the matching of the antenna configuration. At the edge of the lower sub-band at 1880 MHz for example the reflection $s_{11}$ is lowered from −3 dB at point C to −8 dB at point D. This means that a higher portion of the input signal (between 15% to 20%) is coupled into the antenna configuration than before. This however means a higher total efficiency of the antenna configuration.

Figure 8:
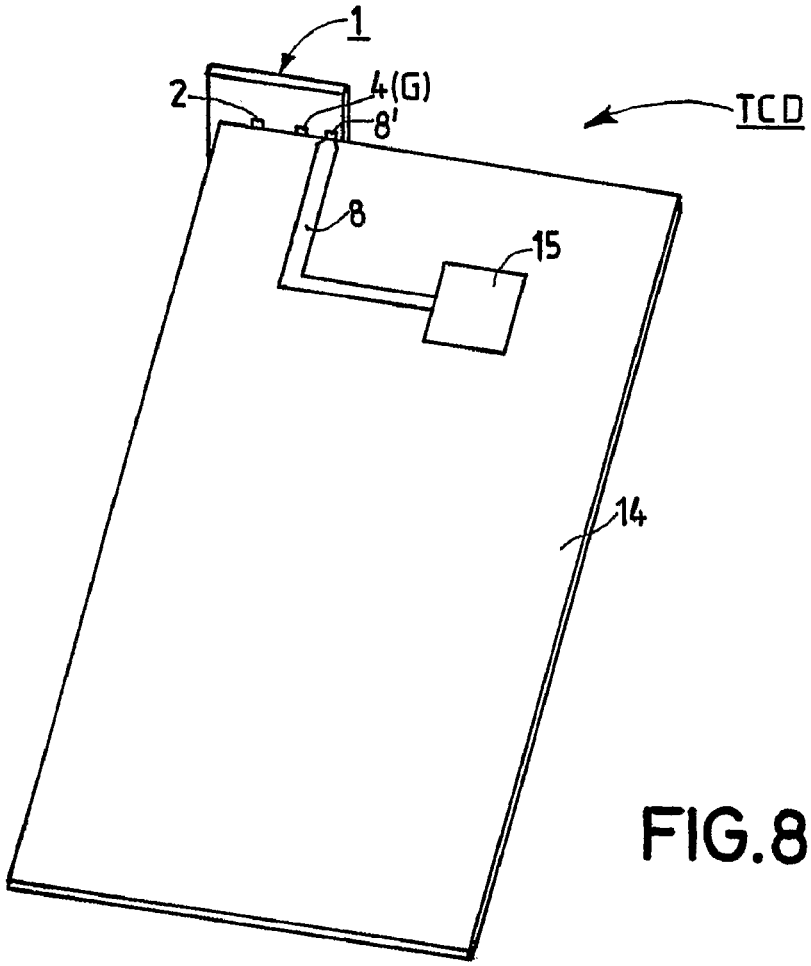
FIG. 8 shows a communication device with an antenna configuration according to FIG. 1.

FIG. 8 shows by means of a principal sketch a telecommunication device TCD with an antenna configuration 1 according to the invention. The telecommunication device TCD comprises a printed circuit board 14 retaining the antenna configuration 1. Other components of the telecommunication device TCD are not shown for simplicity. The main surfaces of the antenna configuration 1 are vertically aligned to the main surfaces of the printed circuit board 14. The printed circuit board 14 has a feed line 8 connecting the feed electrode 8' to a frequency generator 15. In conformance with FIG. 1 only three pads are seen on the surface of the antenna configuration 1 as the antenna structure is located in the interior of the antenna configuration 1 and not shown in FIG. 8. Apart from the pad belonging to feed electrode 8' the pads belonging to ground G and to the control electrode 2 can be recognized.

LIST OF REFERENCE SIGNS

1 antenna configuration
2 control electrode
3 switching means
3∝ switch
4 ground
5 dielectric substrate
6 first resonator structure
7 second resonator structure
8 feed line
8' feed electrode
9 pin diode
10 auxiliary resonator structure
11' first via
11" second via
11'" third via
12 DC-source
13 port
14 printed circuit board
15 frequency generator
A, B, C, D points
a, b, c, d vertical lines
AS antenna structure
CC control circuit
CP coupling point
F frequency
G ground
RS combined resonator structure
$s_{11}$ scattering parameter
TCD telecommunication device

The invention claimed is:

1. Antenna configuration for a telecommunication device, wherein the antenna configuration comprises a first resonator structure, a second resonator structure, and a control electrode, wherein said first and second resonator structures are capacitively coupled to one another, said control electrode being contactable from outside the antenna configuration for changing the capacitive coupling between the first resonator structure and the second resonator structure, wherein a switching means is associated with the control electrode, the switching means enabling switching a connection of the control electrode to a reference potential characterized in that the switching means comprises a switch and a pin diode, said pin diode is powered by a DC-source and switchable by means of the switch either into a non-conductive mode or into a conductive mode in which the switchable connection between the control electrode and the reference potential is short circuited.

2. Antenna configuration according to claim 1, wherein the reference potential is ground.

3. Antenna configuration according to claim 1, wherein the antenna configuration comprises a planar inverted F antenna or a shorted patch antenna or a stub antenna.

4. Antenna configuration according to claim 1, wherein the antenna configuration comprises a dielectric substrate retaining the first resonator structure and the second resonator structure, the first resonator structure is connected to a feed line provided on the dielectric substrate, and the second resonator structure is electrically isolated from the first resonator structure, by means of the dielectric substrate and located adjacent to the first resonator structure, wherein the second resonator structure is connected to ground.

5. Antenna configuration according to claim 4, wherein the first resonator structure and the second resonator structure are implemented as printed structures printed on a surface of the dielectric substrate.

6. Antenna configuration according to claim 4, wherein the first resonator structure and the second resonator structure are at least partially located in the interior of the dielectric substrate.

7. Antenna configuration according to claim 6, wherein the antenna configuration is manufactured by usage of low temperature cofired ceramic technology.

8. Telecommunication device, comprising an antenna configuration according to claim 1.

* * * * *